United States Patent [19]

Sikora et al.

[11] Patent Number: 4,970,886

[45] Date of Patent: Nov. 20, 1990

[54] STRETCH SHAPING METHOD AND APPARATUS

[75] Inventors: Joseph R. Sikora, Murrysville; Richard B. Jacobus, New Kensington; Thomas J. Rodjom, Murrysville; William R. Arthur, Churchill Borough, all of Pa.

[73] Assignee: Aluminum Company of America, Pittsburgh, Pa.

[21] Appl. No.: 396,892

[22] Filed: Aug. 21, 1989

[51] Int. Cl.[5] ..... B21D 25/00; B21D 39/08

[52] U.S. Cl. ..... 72/302; 72/57

[58] Field of Search ..... 72/302, 296, 297, 57, 72/58, 41

[56] References Cited

U.S. PATENT DOCUMENTS

| | | | |
|---|---|---|---|
| 2,927,372 | 3/1960 | Powell | 72/302 |
| 3,257,832 | 6/1966 | Harvey | 72/302 |
| 3,550,420 | 12/1970 | Swanson | 72/296 |
| 3,552,175 | 1/1971 | Kinnavy | 72/296 |
| 4,704,886 | 11/1987 | Evert et al. | 72/296 |
| 4,827,753 | 5/1989 | Moroney | 72/296 |

FOREIGN PATENT DOCUMENTS

| | | | |
|---|---|---|---|
| 1452957 | 4/1971 | Fed. Rep. of Germany | 72/302 |
| 502779 | 3/1939 | United Kingdom | 72/302 |

*Primary Examiner*—Daniel C. Crane

*Attorney, Agent, or Firm*—William J. O'Rourke, Jr.; Daniel A. Sullivan, Jr.

[57] ABSTRACT

A method for stretch shaping an elongated metallic extrusion is disclosed comprising the steps of applying axial tension to an elongated metallic extrusion in an amount sufficient to equal or exceed the yield strength of the extrusion. An external shaping die is applied against a perimetric portion of the outside surface of the extrusion. The die has working faces conforming substantially to a finished cross-sectional shape for the extrusion. While maintaining such tension the die is advanced along a length of the extrusion. An apparatus for stretch shaping an elongated metallic extrusion is also disclosed.

7 Claims, 2 Drawing Sheets

STRETCH SHAPING METHOD AND APPARATUS

BACKGROUND OF THE INVENTION

1. Field of Invention

This invention pertains to a method and an apparatus for shaping an elongated hollow or solid article, and more particularly to a method and apparatus for performing consistent, accurate spatial dimensional shaping of an elongated extruded product.

2. Description of the Art

There are a considerable number of operating parameters and conditions present in various metal forming methods which cause finished products to exhibit dimensional variability. In certain processes the dimensional variability is acceptable, while in other processes the dimensional variability is unacceptable and requires subsequent metal finishing operations.

In the extrusion process, for example, a heated ingot or billet is forced to flow under pressure through a die opening to form an elongated article such as a channel, a tube or an angle. In a typical aluminum extrusion process the extruded product is forced through the die at forces in the 500 to 15,000 ton range. The extrusion exits the die of an extrusion press at elevated temperatures on the order of 300° to 1200° F. It is common to solution heat treat and quench the extruded product in an in-line solution heat treating process or by a separate solution heat treatment process. Such extruded product may be made to various lengths, including lengths in excess of 150 feet, and may be of diverse cross-sectional configuration.

Considering the operating parameters of the extrusion process including pressures, temperatures, die condition and product length, and considering the effects of subsequent heat treatment and quenching, it is understandable that extruded metal products may exhibit considerable dimensional variation about the cross-section and over the length of the product. It is also understandable that such dimensional variation may be present from product cycle to product cycle and from extrusion run to extrusion run. It is therefore often necessary to perform subsequent metal finishing operations to bring the product within acceptable dimensional tolerance. There are some dimensional variations on extruded metal products which are not readily correctable by conventional metal finishing operations, including bending, roll straightening and hammering. In such conventional metal finishing operations, springback is a major concern. Such springback may be so extreme, especially in products with substantial dimensional variation, that such conventional metal finishing operations are inadequate.

Prior shaping methods and apparatus have provided methods to finish the shape of articles, such as extrusions. The tolerances currently permissible for such products, as published by the Aluminum Association, particularly for thin walled extrusions, are so broad that the products may be precluded from certain critical applications. If the dimensional deviation could be reduced, the products may be applicable in an increased number of applications where dimension is important. Furthermore, the dimensional quality of the product in existing applications could be dramatically increased.

Despite prior art attempts to improve the dimensional tolerance and minimize dimensional variation in a finishing operation, there is a need for further improvement. Accordingly, a stretch shaping method and apparatus are desired which results in finish shaping an elongated article, such as an extrusion, to minimize cross-sectional and longitudinal dimensional deviations from nominal value.

SUMMARY OF THE INVENTION

This invention may be summarized as providing an improved method and apparatus for finish shaping an elongated metallic extrusion. The method comprises the steps of applying axial tension to an elongated metallic extrusion in an amount sufficient to exceed the yield strength of the extrusion. An external shaping die is applied against a perimetric portion of the outside surface of the extrusion. The die has working faces conforming approximately to a finished cross-sectional shape for the extrusion. While maintaining tension, the die is advanced along a length of the extrusion. In a preferred embodiment an internal shaping die may be utilized, in conjunction with an external shaping die, against the inside surfaces of an extrusion.

Among the advantages of the present invention is the provision of a method for shaping an elongated metallic extrusion with minimal dimensional variability.

Another advantage of the present invention is the provision of a method and an apparatus for performing consistent spatial dimensional corrections to an extruded product in a process which involves minimal, if any, springback.

An objective of this invention is to provide a final shaping method which can be readily employed in-line with an extrusion process.

A feature of the method of this invention is that an extruded product is shaped to finished dimension without inducing significant residual stresses in the product.

Another feature of this invention is that extruded aluminum product can be shaped to a dimensional tolerance better than the dimensional tolerance currently accepted by the Aluminum Association and within the tighter dimensional tolerance currently accepted European aluminum standards.

Another advantage of this invention is the production of extrusions within previously unattainable tolerance, which permits the use of extrusions in new, dimensionally critical applications.

These and other objectives, features and advantages of the invention will be more thoroughly understood and appreciated with reference to the following description and the accompanying drawings.

DESCRIPTION OF THE PREFERRED EMBODIMENTS

The present invention is directed to a method and apparatus for shaping elongated products, such as extrusions, into final dimension with close dimensional tolerance. Because of the number and the complexity of the various operating parameters for extruded product, including quenching, extrusions are typically characterized by wide dimensional variability. Such dimensional variability is due to a lack of consistent control of the extrusion and quenching process, tooling design and maintenance, and thermal distortion. Prior reworking processes to correct the dimensional variation were costly and inefficient. The present invention overcomes those deficiencies by providing a method for consistently correcting the axial and cross-sectional dimensional variation of straight length, elongated extrusions.

Figure 1:
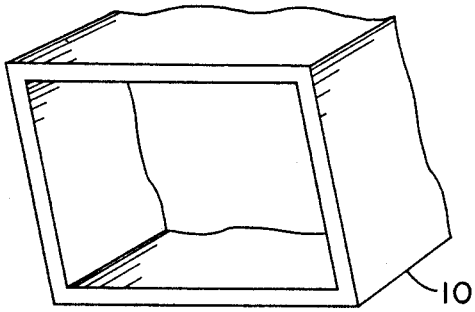
FIG. 1 is a partial, perspective view of an elongated, hollow metallic extrusion in the as-extruded, solution heat treated and quenched condition.
Figure 2:
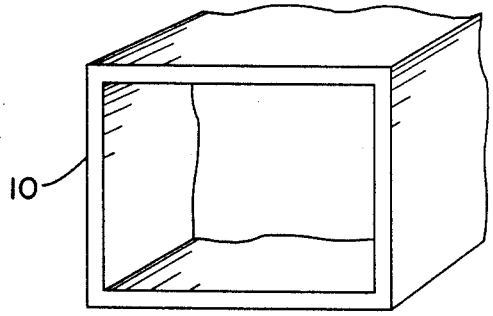
FIG. 2 is a partial, perspective view of the elongated, hollow metallic extrusion of FIG. 1 after stretch shaping by the present invention.
Figure 3:
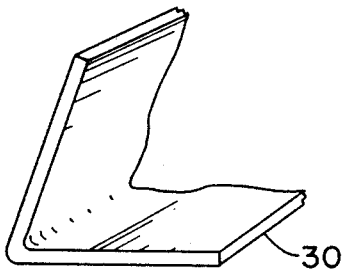
FIG. 3 is a partial, perspective view of an elongated, solid metallic extrusion in the as-extruded and solution heat treated (quenched) condition.
Figure 4:
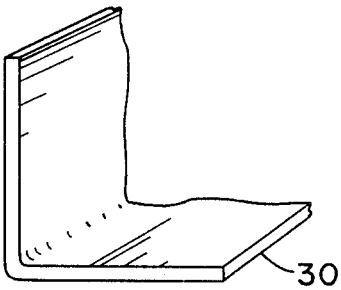
FIG. 4 is a partial, perspective view of the elongated, solid metallic extrusion of FIG. 3 after stretch shaping by the present invention.

Straight length extrusions include both complicated and simple shapes, and include complex hollow to simple solid structures. FIG. 1 illustrates a relatively simple four walled hollow extrusion 10. FIG. 3 illustrates a relatively simple solid (open) angle extrusion 30. Preferred extrusions of the present invention include, but are not limited to, thin walled extrusions, i.e., those having a wall thickness of less than about 4 mm, which typically exhibit more distortion during extrusion and quenching than thick wall extrusions. Such preferred extrusions include highly ductile extrusions, such as 6XXX series aluminum alloys, and harder aluminum alloys in the 2XXX and 7XXX series, as well as aluminum-lithium alloys. Extrusions which are preferred for applications in the automobile and aircraft industries and may be stretch shaped by the process of the present invention include, but are not limited to, 2024, 6061, 6063, 6009 and 7075 aluminum alloys.

In the process of the present invention an elongated extrusion is stretch shaped to final dimension. The starting workpiece is the extrusion typically after the product has been solution heat treated. Such extrusions are elongated, and may extend to lengths which exceed as much as 150 feet in length. Longer extrusions minimize the end scrap losses as a percentage of total finished product and are therefore desirable. An extrusion in the extruded and quenched condition may exhibit a warp, bow, wave, bulge or, as shown in FIG. 1, an out-of-dimension distorted cross-sectional condition as a result of the variables in the extrusion and quenching process. It is understandable that in addition to the out-of-dimension cross-sectional configuration, as illustrated in FIG. 1, the extrusion may exhibit bow, waves or twist along the length thereof.

Such extrusions must first be put into axial, or longitudinal, tension in the process of the present invention. In the present invention an elongated extrusion is transferred to a stretch shaping apparatus. The extrusion is gripped, typically at longitudinal end portions of the extrusion by an appropriate gripper mechanism, such as stationary gripper 70 and adjustable gripper 72 shown in FIG. 6. It should be understood that both grippers may be adjustable in the present invention. In a preferred embodiment the engaging faces of the gripper mechanism match the contour and shape of the extrusion to enhance the grip. Such gripping devices are called custom grippers and tend to minimize or eliminate adverse end effects by insuring that substantially uniform tension is applied over the entire cross-section, along the entire length of the extrusion, including the end portions which are inbound of the gripping device. To further enhance the grip, the engaging faces of the gripper mechanism may be provided with a treated finish such as a knurled or saw tooth finish, or with a rubber, rubberized or elastomeric or polymeric surface treatment. Certain saw tooth structures act to enhance the holding effects as tension is applied to the gripped product.

Figure 6:
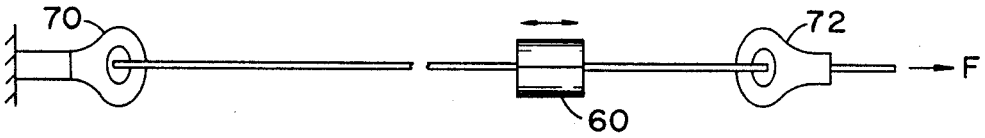
FIG. 6 is a schematic, elevation assembly view of an apparatus of the present invention.

The gripping mechanism may be applied by any method, but hydraulic or pneumatic clamping devices are preferred. The extrusion may be held stationary at one end and the other end may be pulled to provide the required axial tension as shown in FIG. 6. Alternatively, both longitudinal ends of the gripped extrusion may be simultaneously pulled to provide the required axial tension. Axial tension is typically applied using a hydraulic cylinder or mechanical drive as the tensioning source for the force F.

What is required in the method of the present invention is that the gripped end portions subject the portions of the extrusion therebetween to axial tension, or longitudinal tension, by applying sufficient force, typically opposing force in longitudinally opposite directions. It should be understood that applying force in one direction while retaining one end of an extrusion in stationary position could also be employed to provide axial tension greater than or equal to the yield point of the extrusion. The axial tension must be sufficient to equal or exceed the yield strength, or elastic limit, of the material. It will be appreciated by those skilled in the art that yield strength is a function of the metallurgy of the material, i.e., alloy deformation history and temper. The amount of force required to equal or exceed the yield strength will further be a function of the cross-sectional area of the extrusion. Exemplary yield strengths for extruded aluminum products are as follows:

| Aluminum Alloy | Temper | Yield Strength (ksi) |
|---|---|---|
| 6009 | T4 | 24 |
| 6009 | T6 | 41 |
| 6061 | T4 | 21 |
| 6061 | T6 | 40 |
| 6063 | T4 | 13 |
| 6063 | T6 | 31 |
| 7075 | T6 | 73 |
| 2024 | T4 | 47 |

As is explained in detail below, the shaping of the extrusion of the present invention removes shape irregularities including bows, twists and bends in the extrusion cross-section and length. As such surface deformations are removed, the longitudinal length of the extrusion typically increases. Also, in the application of the axial tension, the length of the extrusion increases at least about 0.25 percent, due to permanent longitudinal stretch. Permanent longitudinal stretch experienced in applying sufficient tension to all elements of the products for 6XXX alloys is typically less than about 3% permanent stretch, and for certain alloys may be on the order of 0.5%. For harder alloys, permanent longitudinal stretch may exceed about 2–3%, and, for certain aluminum-lithium alloys, permanent longitudinal strength could exceed about 6–7%. As the length of the extrusion increases, the axial tension is held constant or varied to maintain a stress condition at or above the yield strength of the extrusion. This may be accomplished by setting the axial tension and providing suitable measuring and controlling instrumentation to cause the gripping mechanism to move in response, such as with a hydraulic cylinder control, as required to maintain the sufficient axial tension throughout the stretch shaping operation. The combination of applying a specific percentage of axial stretch in combination with the shaping operation further improves tolerances by taking advantage of the Poisson's ratio effect on the cross-section.

Before or after the axial tension is applied to the extrusion, an exterior shaping die 60 is applied to an outer peripheral portion of the extrusion. The exterior shaping die is provided with working faces which conform to the final desired cross-sectional shape of the extrusion. In certain instances, the shaping die may be provided with working faces which overcompensate for anticipated minor springback which may be experienced in the shaping process. In a preferred embodiment, the exterior shaping die is formed of two or more portions which are applied over the extrusion, at a location at or near one longitudinal end portion of the clamped extrusion, and are clamped together with a suitable clamping device such as jack screws, or pneumatic or hydraulic clamps, to lock the die together. It will be understood by those skilled in the art that certain complex extrusions will require multiple die sections to accommodate complex cross-sectional configurations.

Once the exterior shaping die is applied to the extrusion and the extrusion is in axial tension, the exterior shaping die is advanced in either direction, or sequentially in both directions, along the longitudinal length of the extrusion. It will be appreciated that the concept of die advance includes the use of a stationary die through which an extrusion which is maintained in sufficient axial tension is passed. The die may be mounted on a traveling mechanism, such as a rail guided car, which insures that the die travels in a path which is coincident with the longitudinal axis of tension of the extrusion. In a preferred embodiment, the shaping die is mounted to a traveling mechanism, or car, which travels along rails which run synchronously with the longitudinal axis along which the axial tension is being applied. Alternatively, a cable or cables may be applied to the die to pull the die along the longitudinal axis of tension to shape the extrusion. It has been found that die guides in the traveling mechanism insure minimum deviation from the die travel direction during shaping. The rate of travel of the die may vary, and it has been found that speeds up to 200 feet per minute are adequate to stay ahead of the speed of the extruder in an in-line extrusion process. Die speeds up to 400 feet per minute has no adverse effects on the shaping process based on theoretical evaluations. The working faces of the die act to work the exterior walls of the extrusion to plastically deform aluminum extrusions within or better than the standard tolerance currently established by various American and European associations including the Aluminum Association. In a preferred embodiment, the process of the present invention typically brings the finished extrusion to within less than half of the current standard tolerance established by the Aluminum Association for aluminum extrusions.

Figure 5:
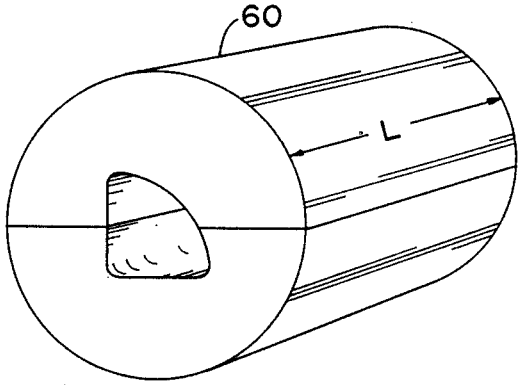
FIG. 5 is a perspective view of an external shaping die.

The exterior shaping die such as two piece die 60 shown in FIG. 5 of the present invention must be of sufficient strength, and there must be sufficient lubricity to permit plastic deformation in working and reorientation of the material of the extrusion. Exemplary die materials for the working faces of the die include, but are not limited to, steel alloys, zinc alloys, graphite impregnated nylon and certain epoxy die materials. A preferred die material is a cast zinc alloy sold under the trade name Kirksite.

The axial length L of the die 60, as shown in FIG. 5, must be sufficient to work the extrusion material. It has been found that the die length should exceed about 0.5 inch and may exceed 12 inches. It will be appreciated that multiple dies may be utilized in the present invention to shape extrusions in stages.

In one embodiment the axial tension applied to the extrusion may be slightly less than the yield strength of the extrusion, such as at 90% of the yield point. However, the action of the advancing shaping die may be adequate to cause the total axial tension to which the extrusion is exposed to exceed the yield point of the extrusion and thereby cause the extrusion to be shaped into dimensional conformity as the die is advanced.

In a preferred embodiment of stretch shaping, there should be adequate lubricity to permit the die to travel freely along the extrusion and perform localized deformation of the extrusion. Such lubrication may be provided in the die material such as through the use of certain epoxy material or through impregnation with materials such as graphite. Alternatively, a thin film of medium weight lubricant may be applied separately or automatically ahead of the die such as from an applicator that may be integrally attached to the travelling mechanism, to the extrusion to enhance the process with a minimum surface residue. Lubrication reduces variations in axial force of the die on the axial tension control system, and also improves surface appearance.

In a preferred embodiment an interior shaping die may be employed with hollow portions of extrusions. Such interior dies could be employed independent of, or simultaneously with, the exterior shaping die to improve and enhance the final dimensional tolerance of the extrusion. In some cases an external and an internal die combination can be used in axial alignment to one another during shaping to enhance deformation. An interior shaping die conforms substantially to the finished inside cross-sectional shape or dimension of a closed or substantially closed extrusion. A cable mechanism is typically employed to pull the interior shaping die and thereby advance the die through the extrusion along a path coincident with the axis of axial tension.

In another embodiment hollow chambers of elongated extrusions may be filled with a fluid to provide uniform pressure against the inside walls of the extrusion along the length thereof as an exterior shaping die is advanced along the length of the extrusion. Such internal fluid and pressure may be provided such as by the method disclosed in U.S. Pat. No. 4,704,886, the contents of which are incorporated herein by reference. However, the internal pressure of this embodiment may be utilized intentionally prior to advancing the shaping die to outwardly bulge surfaces of a hollow extrusion, which outwardly bulged surfaces may be subsequently worked into dimensional tolerance with the use of an external shaping die. In instances where such pressure is utilized to deform the extrusion, such pressure is typically released prior to the subsequent working with the external shaping die by the process of this invention. The process of the present invention is typically performed at ambient temperatures but may be performed in certain cases and with certain alloys at elevated or at lower temperatures, such as to maintain or alter temper during deformation.

After the extrusion is shaped under axial tension, the exterior shaping die is opened, the tension is relaxed, or vice versa, and the extrusion is removed from the apparatus. The extrusion should be able to be stretch shaped and removed within the time it takes to extrude product to such length. Therefore, the method of the present invention could be utilized if desired as an in-line process for typical extrusion operations.

The stretch shaping process of this invention may also be employed on multiple extrusions simultaneously. In such embodiment, multiple extrusions may be placed and maintained in axial tension with one, or more, gripping devices. With the multiple extrusions in axial tension, above the yield strength of the material, an external shaping die, which may be constructed as a unitary die assembly with multiple shaping ports, is advanced along the length of the multiple extrusions. The die ports have working faces which conform approximately to the finished cross-sectional configuration of the respective extrusion which fits in such port during stretch shaping.

Figure 7:
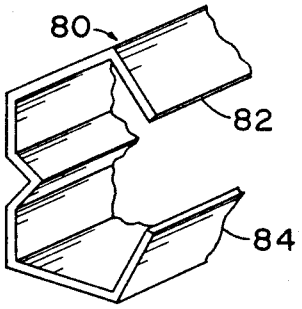
FIG. 7 is a partial, perspective view of an elongated, solid metallic extrusion of somewhat complex shape in the as-extruded and heat treated (quenched) condition.
Figure 8:
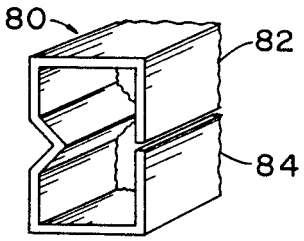
FIG. 8 is a partial, perspective view of the elongated extrusion of FIG. 7 after stretch shaping by the present invention.

In another embodiment the stretch shaping invention may be employed to partially reshape extrusions. For example, certain extrusions cannot readily be made to final desired configuration due, for example, to limitations in extrusion tooling. Yet, by the process of this invention, such desired configurations may be obtained by a stretch shaping operation. For example, FIG. 7 illustrates a partial perspective view of a somewhat complex shaped extrusion 80. FIG. 8 illustrates a final desired configuration for the extrusion 80 shown in FIG. 7. Such final desired configuration may be accomplished by advancing a die having working faces conforming substantially to the final desired cross-sectional configuration of the extrusion, along the longitudinal axis of the extrusion while the extrusion is in axial tension above the yield point of the extruded material. Such shaping brings end portions 82 and 84 in close proximity to one another along the length of the extrusion, which final configuration may not be readily obtainable in an extrusion process. In addition to closing portions 82 and 84, the stretch shaping operation accurately corrects other dimensional deviations that may need correcting along the length of the extrusion, such as bows, twists or bends. Likewise, the stretch shaping method may be employed, for example, to shape extruded flanges where it may be desirable to create shaped pockets or envelopes to house wire, cable or the like.

This invention provides a method of performing consistent spatial dimensional corrections to an elongated extruded product with an in-line electro-mechanical apparatus without inducing significant residual stresses in the extrusion. In any event, the residual stresses created by the stretch shaping method are less than the stresses normally created by alternative local deformation operations and shape reorientation methods.

What is believed to be the best mode of the invention has been described above. It will be apparent to those skilled in the art that numerous variations of the illustrated and described details may be made without departing from the scope of this invention.

We claim:

1. A method of shaping an elongated metallic extrusion comprising the steps of:

applying axial tension to at least a portion of the elongated metallic extrusion in an amount sufficient to equal or exceed the yield strength of the extrusion, applying against a perimetric portion of the outside surface of the extrusion an external shaping die having working faces conforming substantially to a finished cross-sectional shape for the extrusion, with total axial tension greater than or equal to the yield strength of the extrusion, advancing the external shaping die along a length of the extrusion, which is in axial tension, in the extruded direction, to shape the metallic extrusion and exposing a hollow interior of the extrusion to a fluid medium to impose an outwardly directed force uniformly over the interior periphery of the extrusion at a pressure insufficient to cause outward plastic deformation of the walls of the extrusion, and maintaining the outwardly directed force as the exterior shaping die is advanced along a length of the extrusion.

2. A method as set forth in claim 1 wherein the metallic extrusion is aluminum.

3. A method as set forth in claim 1 wherein the axial tension applied to the extruded product initiates permanent elongation of the extrusion of at least 0.25 percent.

4. A method of finish shaping at least one elongated, thin walled, hollow aluminum extrusion comprising the steps of:

solution heat treating said extrusion, mechanically gripping opposed longitudinal end portions of each elongated aluminum extrusion, forcibly pulling said gripped end portions to apply to each extrusion, longitudinal tension of substantially uniform tension over the cross section of the extrusion, of sufficient magnitude to equal or exceed the yield point of the extrusion material and initiate permanent elongation of at least 0.25 percent, applying against a portion of the outside surfaces of each extrusion, working faces of a longitudinally movable shaping die, said working faces having a length of at least 0.5 inch, and conforming approximately to finished cross-sectional shape for each extrusion, after the working face to extrusion surface interface is lubricated, while continuing to control the longitudinal tension greater than or equal to the yield point of the extrusion material, advancing the shaping die along substantially the entire length of each extrusion between gripped end portions, along a path coincident with the axis of longitudinal tension, relaxing the longitudinal tension, releasing the mechanical grip, and removing each extrusion.

5. An apparatus for finish shaping an elongated metallic extrusion comprising:

a gripping device for gripping opposed longitudinal end portions of each elongated metallic extrusion, means for forcibly pulling the gripped end portions of each extrusion to create sufficient axial tension to exceed the yield strength of each extrusion, an external shaping die having working faces conforming substantially to finished exterior cross-sectional shape for each extrusion, applied against a perimetric portion of the outside surface of the extrusion, means for advancing the external shaping die along a length of each extrusion to shape the metallic extrusion, and means for introducing a fluid medium into a hollow interior of the extrusion to impose an outwardly directed force uniformly over the interior periphery of each extrusion, at a pressure insufficient to cause outward plastic deformation of the walls of each extrusion, while the exterior shaping die is advanced along a length of each extrusion.

6. An apparatus for finish shaping an elongated metallic extrusion comprising:

a gripping device for gripping opposed longitudinal end portions of each elongated metallic extrusion, means for forcibly pulling the gripped end portions of each extrusion to create sufficient axial tension to exceed the yield strength of each extrusion, an external shaping die having working faces conforming substantially to finished exterior cross-sectional shape for each extrusion, applied against a perimetric portion of the outside surface of the extrusion, means for advancing the external shaping die along a length of each extrusion to shape the metallic extrusion, and means for introducing a fluid medium into a hollow interior of the extrusion to impose an outwardly directed force uniformly over the interior periphery of each extrusion at a pressure sufficient to cause outward plastic deformation of the walls of each extrusion, and releasing such outwardly directed force, prior to advancing the exterior shaping die along a length of each extrusion.

7. An apparatus as set forth in claim 6 including seals at opposed longitudinal end portions of the hollow extrusion.

* * * * *